US005219723A

United States Patent [19]

Price et al.

[11] Patent Number: 5,219,723

[45] Date of Patent: Jun. 15, 1993

[54] GREEN SENSITIZING DYES FOR VARIABLE CONTRAST PHOTOGRAPHIC ELEMENTS

[75] Inventors: Harry J. Price, Webster; Paul B. Gilman, Penfield; Thomas R. Dobles, Hilton; Linda J. Knapp, Rochester, all of N.Y.

[73] Assignee: Eastman Kodak Company, Rochester, N.Y.

[21] Appl. No.: 774,440

[22] Filed: Oct. 10, 1991

[51] Int. Cl.[5] ..... G03C 1/005

[52] U.S. Cl. ..... 430/588; 430/576

[58] Field of Search ..... 430/588, 576

[56] References Cited

U.S. PATENT DOCUMENTS

| | | | |
|---|---|---|---|
| 2,202,026 | 5/1940 | Renwick | 430/503 |
| 2,280,300 | 4/1942 | Potter et al. | 430/583 |
| 2,336,260 | 12/1943 | Knott | 430/571 |
| 2,358,060 | 9/1944 | Davey | 430/571 |
| 2,358,169 | 9/1944 | Kridel | 430/571 |
| 2,367,508 | 1/1945 | Knott | 430/571 |
| 2,384,598 | 9/1945 | Carroll | 430/571 |
| 2,411,096 | 11/1946 | Knott | 430/568 |
| 2,620,272 | 12/1952 | Schwartz | 430/571 |
| 2,944,901 | 7/1960 | Carroll | 430/592 |
| 2,947,631 | 8/1960 | Carroll | 430/576 |
| 3,628,960 | 12/1971 | Merteel et al. | 430/571 |
| 3,808,008 | 4/1974 | Shiba et al. | 430/574 |
| 3,837,862 | 9/1974 | Shiba et al. | 430/523 |
| 3,865,598 | 2/1975 | Shiba et al. | 430/550 |
| 3,973,969 | 8/1976 | Shiba et al. | 430/567 |
| 4,018,610 | 8/1977 | Hinata et al. | 430/574 |
| 4,039,335 | 8/1977 | Hinata et al. | 430/574 |
| 4,118,228 | 10/1978 | Corluy et al. | 430/367 |
| 4,175,967 | 11/1979 | Krause | 430/503 |
| 4,179,296 | 12/1979 | Sato et al. | 430/574 |
| 4,230,795 | 10/1980 | Krause | 430/503 |
| 4,359,280 | 11/1982 | Krause | 430/506 |
| 4,442,201 | 4/1984 | Takada et al. | 430/569 |
| 4,552,837 | 11/1985 | Okazaki et al. | 430/576 |
| 4,555,482 | 11/1985 | Inoue et al. | 430/574 |
| 4,657,846 | 4/1987 | Kokubo et al. | 430/588 |
| 4,659,654 | 4/1987 | Metoki et al. | 430/588 |
| 4,801,526 | 1/1989 | Yoshida et al. | 430/588 |
| 4,806,446 | 2/1989 | Hatta et al. | 430/138 |
| 4,885,607 | 12/1989 | Farb | 355/71 |
| 4,987,063 | 1/1991 | Kampfer et al. | 430/588 |

FOREIGN PATENT DOCUMENTS

| | | |
|---|---|---|
| 3028167A1 | 1/1982 | Fed. Rep. of Germany . |
| 547432 | 8/1942 | United Kingdom . |
| 547883 | 9/1942 | United Kingdom . |
| 1390247 | 4/1975 | United Kingdom . |

OTHER PUBLICATIONS

Morrison and Boyd, "Organic Chemistry", Third Edition, p. 360, Allyn and Bacon, Inc., 1975.

Carey and Sundberg, "Advanced Organic Chemistry", pp 481–485, Plenum Press, 1984.

*Primary Examiner*—Charles L. Bowers, Jr.

*Assistant Examiner*—Thomas R. Neville

*Attorney, Agent, or Firm*—Gordon M. Stewart

[57] ABSTRACT

A variable contrast photographic element containing a light sensitive silver halide emulsion layer is disclosed wherein the silver halide is sensitized with a benzimidazolooxacarbocyanine dye of the following formula (I) in an amount less than that required to impart maximum sensitivity to all of the silver halide in the emulsion.

(I)

In formula (I), $R^1$, $R^2$, $R^6$ and $R^7$ each independently represent hydrogen, halogen, hydroxy, or substituted or unsubstituted alkyl, alkenyl, alkoxy, alkylamino, alkylthio, aryl, aryloxy, arylamino, or arylthio. $R^3$ and $R^4$ each independently represent substituted or unsubstituted alkyl. $R^5$ represents a substituent containing an electron withdrawing group. X represents a counterion as needed to balance the charge of the molecule. Use of dyes of formula (I) having an $R^5$ substituent wl contains an electron withdrawing group has been found to beneficially reduce the sensitivity of variable contrast photographic elements at wavelengths longer than 570 nm, thereby enhancing safelight tolerance, while still maintaining good spectral sensitivity at wavelengths in the green region less than 560 nm.

17 Claims, No Drawings

GREEN SENSITIZING DYES FOR VARIABLE CONTRAST PHOTOGRAPHIC ELEMENTS

FIELD OF THE INVENTION

This invention relates to dyes, and more particularly to their use as green spectral sensitizers for photographic materials containing an emulsion which is sensitive in the green and blue regions of the spectrum and which has variable contrast properties.

BACKGROUND OF THE INVENTION

When making prints from photographic negatives, it is desirable to use photographic paper which has a contrast selected to achieve satisfactory tone-reproduction of the original image based upon the contrast of the negative. Papers having higher contrasts, for example, are useful in printing negatives that themselves exhibit low contrasts, so that a satisfactory final print can be achieved. As such, photographic manufacturers offer several grades of photographic paper. In order to avoid the need for separate papers of different grades, papers possessing the ability to achieve different, selected, contrasts depending upon the wavelength of exposing light have also been employed.

Various methods for obtaining variable, or selective, contrast properties in single photographic elements have been proposed. Early proposals included photographic elements containing two distinct emulsions, such as a high contrast silver chloride emulsion which has been dyed so as to render it sensitive to green light and a low contrast silver bromide or silver chlorobromide emulsion with inherent sensitivity to blue light as disclosed in U.S. Pat. No. 2,202,026. With such a combination of emulsions, a high contrast negative could be exposed through a filter passing only blue light, to which the low contrast emulsion is sensitive, thus producing a print of normal contrast. Alternatively, a low contrast negative could be exposed through a filter passing only green light to which only the high contrast emulsion is sensitive, thus again producing a print of normal contrast.

Use of emulsions of different halide types in order to achieve differences in contrast, however, resulted in complications due to different rates of development of the two emulsions. For negatives which do not fall at either extreme of contrast, and which thus require both emulsions to contribute to the final image in varying amount, the different rates of development made it difficult to judge accurately the adjustment of development time and exposure to optimize the final appearance of a print. Image tone was also found to vary depending upon the relative contribution of each emulsion to the final print.

A second approach to providing a variable contrast system involved the use of a single type of emulsion, but the whole emulsion was not completely dyed. This approach requires the use of a sensitizing dye which itself alters the contrast of the emulsion it is used with. A portion (e.g. less than half) of the emulsion may be dyed with sufficient dye to give the silver halide grains of that portion high sensitivity to a wavelength outside the inherent sensitivity and a different contrast without exceeding the adsorptive capacity of the grains, and that portion then mixed with the undyed portion before coating as described in U.S. Pat. No. 2,384,598. Alternatively, the entire single emulsion may be dyed with a restricted amount of a sensitizing dye which controls the contrast of the emulsion depending upon the amount of the dye used as described in U.S. Pat. No. 2,280,300. A variable contrast effect is obtained as a result of an uneven grain-to-grain distribution of the restricted amount of dye which apparently results from preferential adsorption of the dye on some of the silver halide grains.

In many conventional single emulsion type variable contrast systems, an inherently blue sensitive, relatively high contrast silver halide emulsion is partially sensitized with a green sensitizing dye which also reduces the contrast of the emulsion for exposures to green light. The emulsion may also be sensitized with a blue sensitizing dye to enhance the inherent sensitivity in the blue region. Benzimidazolooxacarbocyanine sensitizing dyes have been found to be effective green sensitizing dyes for single emulsion type variable contrast photographic elements. One particular benzimidazolooxacarbocyanine sensitizing dye which has found use in prior art variable contrast photographic elements is the following dye (A):

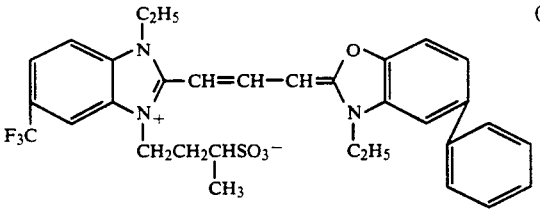

Other benzimidazolooxacarbocyanine dyes useful in variable contrast elements are disclosed in U.S. Pat. No. 4,987,063 and British Patent Specification 1,390,247, the disclosures of which are incorporated by reference.

Care must be taken in the selection of spectral sensitizing dyes in order to provide the desired green sensitization while avoiding sensitization in undesired regions. For example, in variable contrast photographic elements, it is often desirable to maintain insensitivity at "safelight" wavelengths, such as longer than 570 nm. This provides a photographic element, which, while being spectrally sensitized to blue and green wavelengths, may also be handled under light within the safelight region without generating any latent image in the silver halide.

While many benzimidazolooxacarbocyanine dyes have been found to be effective variable contrast green sensitizers, many of them also have been found to be not as tolerant to safelight exposures at wavelengths longer than about 570 nm as would be desirable. It is therefore an object of the invention to provide variable contrast green spectral sensitizing dyes which produce a photographic element with better tolerance to safelight exposures at wavelengths longer than about 570 nm.

SUMMARY OF THE INVENTION

These and other objects are met in accordance with the present invention which provides a variable contrast photographic element containing a light sensitive silver halide emulsion layer, wherein the silver halide is sensitized with a benzimidazolooxacarbocyanine dye of the following formula (I) in an amount less than that required to impart maximum sensitivity to all of the silver halide in the emulsion.

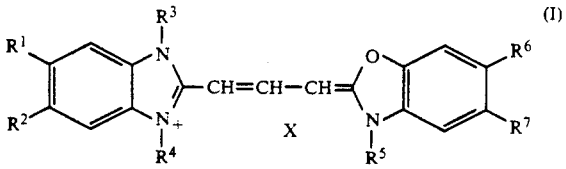

(I)

In formula (I), $R^1$, $R^2$, $R^6$ and $R^7$ each independently represent hydrogen, halogen, hydroxy, or substituted or unsubstituted alkyl, alkenyl, alkoxy, alkylamino, alkylthio, aryl, aryloxy, arylamino, or arylthio. $R^3$ and $R^4$ each independently represent substituted or unsubstituted alkyl $R^5$ represents a substituent containing an electron withdrawing group. X represents a counterion as needed to balance the charge of the molecule. Use of dyes of formula (I) having an $R^5$ substituent which contains an electron withdrawing group has been found beneficial in reducing the sensitivity of variable contrast photographic elements at wavelengths longer than 570 nm, thereby enhancing safelight tolerance, while still maintaining good sensitivity at wavelengths in the green region shorter than 560 nm.

DESCRIPTION OF PREFERRED EMBODIMENTS

In formula (I), $R^1$, $R^2$, $R^6$ and $R^7$ represent hydrogen, halogen (e.g., fluoro, chloro, bromo), hydroxy, substituted or unsubstituted alkyl, alkenyl, alkoxy, alkylamino or alkylthio (preferably of from 1 to about 6 carbon atoms, e.g., methyl, ethyl, propyl, methoxy, ethoxy, methylthio, etc.), or substituted or unsubstituted aryl, aryloxy, arylamino or arylthio (preferably of from about 5 to about 12 carbon atoms, e.g., phenyl, phenyloxy and phenylthio). Aryl $R^1$, $R^2$, $R^6$ and $R^7$ groups may be appended from or fused with (for example to form a naphthyl ring structure) the benzoxazole and benzimidazole nuclei. Examples of substituents for alkyl, alkenyl, alkoxy, alkylamino, alkylthio, aryl, aryloxy, arylamino and arylthio, $R^1$, $R^2$, $R^6$ and $R^7$ include halogen, hydroxy, and other common substituents known in the art. In a preferred embodiment, at least two of $R^1$, $R^2$, $R^6$ and $R^7$ are other than hydrogen. In a particularly preferred embodiment, $R^1$ and $R^6$ are hydrogen, $R^2$ is trifluoromethyl, and $R^7$ is phenyl.

Also in Formula (I), $R^3$ and $R^4$ are substituted or unsubstituted alkyl (preferably of from 1 to about 6 carbon atoms). Examples of unsubstituted $R^3$ and $R^4$ include lower alkyls such as methyl, ethyl, propyl, butyl, pentyl, and hexyl. Preferably, one of $R^3$ and $R^4$ is substituted with an anionic substituent, and no counterion X is needed. Examples of substituents include one or more of sulfo, sulfato, carboxyl, sulfoalkylcarbamoyl, amides, esters, substituted or unsubstituted aryls, and other substituents commonly used in photographic sensitizing dyes. Examples of substituted alkyl $R^3$ and $R^4$ include sulfoalkyl such as sulfopropyl, sulfobutyl, etc.; carboxyalkyl such as carboxyethyl, carboxybutyl, etc.; sulfatoalkyl such as sulfatoethyl, sulfatobutyl, etc.; N,N-dimethylcarbamoylmethyl; methylsulfonylcarbamoylmethyl; sulfoethylcarbamoylmethyl; ethoxycarbonylmethyl; etc. In a most preferred embodiment, one of $R^3$ and $R^4$ is a sulfoalkyl group of from 1 to about 6 carbon atoms.

In formula (I), $R^5$ represents a substituent (preferably alkyl of from 1 to about 6 carbon atoms) containing an electron withdrawing group. Electron withdrawing groups in organic compounds are well-known in the art, such as described in J. March, *Advanced Organic Chemistry,* 3rd Ed., pp. 16–17, 238, the disclosure of which is incorporated herein by reference in its entirety. For the purposes of this invention, a group is considered to be electron withdrawing when its Hammett's sigma(para) constant, $\sigma_p$, is positive. Values of Hammett's constants for many groups can be found in Hansch and Leo, *Substituent Constants for Correlation Analysis in Chemistry and Biology,* John Wiley & Sons, New York 1979, and D. D. Perrin et al., *pKa Prediction for Organic Acids and Bases,* Chapman and Hall, London and New York 1981, the disclosures of which are incorporated by reference. Examples of such groups include fluoro, cyano, acyl, fluoroalkyl, aminocarbonyl, and alkoxycarbonyl.

Preferably, the overall Hammett's sigma(para) constant, $\sigma_p$, for $R^5$ itself is positive. In a preferred embodiment, $R^5$ is selected from the group consisting of fluoroalkyl and cyanoalkyl. In a most preferred embodiment, $R^5$ is a fluoro-substituted alkyl group such as trifluoroethyl.

Depending upon other substituents, a counter ion X may be necessary to balance the charge of the dye molecule. For example, if the dye molecule is substituted with two anionic substituents (e.g., sulfo), then X will be a cation. If the dye molecule is substituted with only one anionic substituent, the counterion X is not present. If the dye molecule is substituted with no anionic substituents, X will be an anion. Such counter ions are well known in the art and examples thereof include cations such as sodium, potassium, triethylammonium, and the like, and anions such as chloride, bromide, iodide, p-toluene sulfonate, methane sulfonate, methyl sulfate, ethyl sulfate, perchlorate, fluoroborate, and the like.

Specific examples of dyes according to the invention include the following dyes I-1 through I-11:

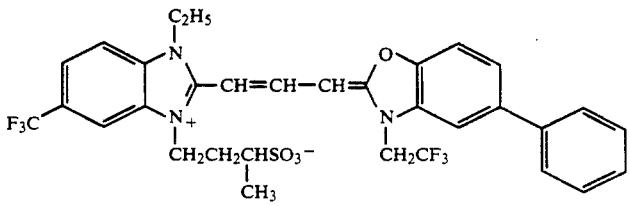

I-1

-continued
I-2
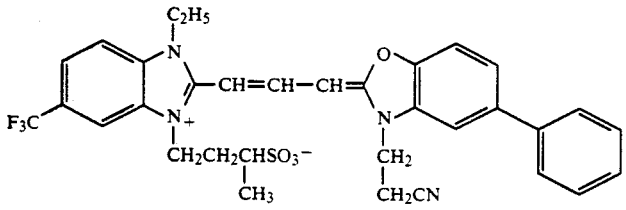
I-3
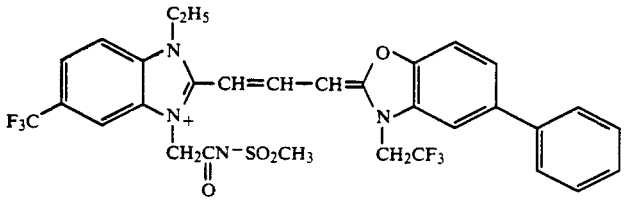
I-4
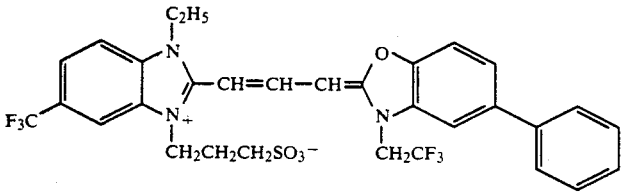
I-5
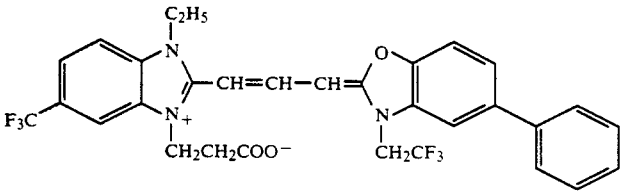
I-6
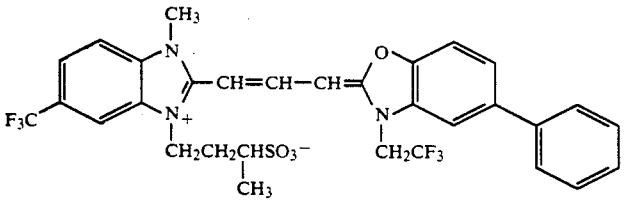
I-7
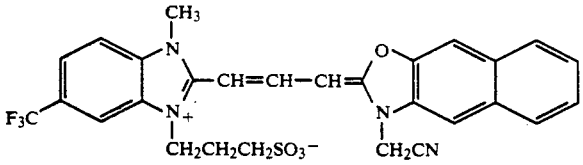
I-8
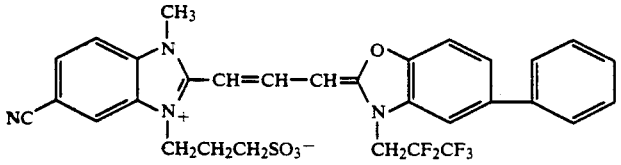
I-9
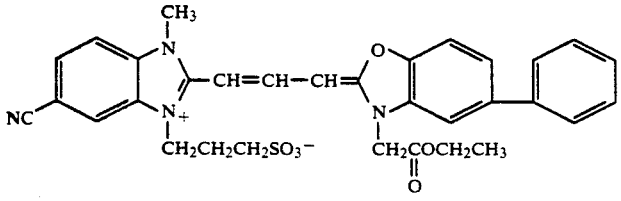

-continued

I-10

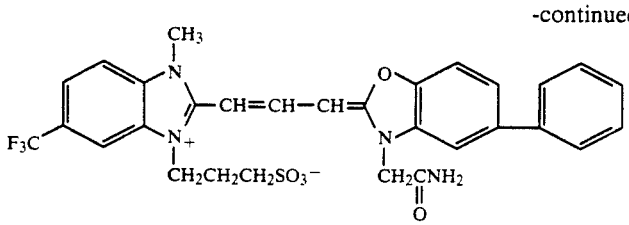

I-11

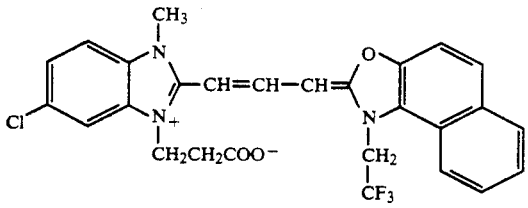

The dyes of formula I can be prepared according to techniques that are well-known in the art, such as described in Hamer, *Cyanine Dyes and Related Compounds,* 1964 and James, *The Theory of the Photographic Process* 4th, 1977, as well as the above referenced patents.

The amount of sensitizing dye that is useful in the invention is preferably selected to achieve a mono-layer of dye adsorbed to about 0.5 to 20% of the silver halide grain surface area. Depending upon the silver halide grain shape and size, this coverage corresponds to a range of from about 1 to about 1000 μmol dye per mol of silver. Optimum dye concentrations can be determined by methods known in the art.

The silver halide used in the practice of the invention can be of any known type, such as silver bromoiodide, silver bromide, silver chloride, silver chlorobromide, and the like. The form of the silver halide grains is not critical and essentially any type of silver halide grains can be used in the practice of the invention. The grains, for example, may be in the form of regular cubes or octahedrons, spherical, or tabular in form. The grain size of the silver halide may have any distribution known to be useful in photographic compositions, and may be either polydisperse or monodisperse. Conventional grain diameters range from about 0.1 to about 1 μm.

The silver halide grains to be used in the invention may be prepared according to methods known in the art, such as those described in *Research Disclosure,* Item 308119, December, 1989 [hereinafter referred to as *Research Disclosure I*] and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., aurous sulfide) and others known in the art. Compounds and techniques useful for chemical sensitization of silver halide are known in the art and described in *Research Disclosure I* and the references cited therein.

The silver halide may be sensitized by the dye of formula I by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element support.

The above-described sensitizing dyes can be used alone, or may be used in combination with other sensitizing dyes, e.g. with blue spectral sensitizing dyes to also provide the silver halide with spectral sensitivity to wavelengths of light outside the green region. Dyes suitable for use as blue sensitizing dyes in variable contrast photographic elements include those disclosed in U.S. Pat. No. 4,987,063 refered to above, the disclosure of which is incorporated by reference. The blue and green sensitizing dyes may be added to the emulsion separately or together. Preferred blue sensitizing dyes and their method of addition to emulsions are the subject of commonly assigned, copending, concurrently filed U.S. Ser. No. 07/774,392 of Henry et al., the disclosure of which is incorporated by reference.

Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount known to be useful in photographic emulsions.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 ° to 80° C., as illustrated in

*Research Disclosure,* June 1975, item 13452 and U.S. Pat. No. 3,772,031.

Other addenda include antifoggants, stabilizers, filter dyes, light absorbing or reflecting pigments, vehicle hardeners such as gelatin hardeners, and coating aids. These addenda and methods of their inclusion in emulsion and other photographic layers are well-known in the art and are disclosed in *Research Disclosure I* and the references cited therein. The emulsion may also include brighteners, such as stilbene brighteners. Such brighteners are well-known in the art and are used to counteract dye stain.

The emulsion layer containing silver halide sensitized with the dye of formula I can be coated simultaneously or sequentially with other emulsion layers, subbing layers, filter dye layers, interlayers, or overcoat layers, all of which may contain various addenda know to be included in photographic elements. These include plastisizers, antifoggants, oxidized developer scavengers, antistatic agents, optical brighteners, light-absorbing or light-scattering pigments, and the like.

The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Photographic elements of the invention can be processed in any of a number of well-known photographic processes utilizing any of a number of well-known processing compositions, described, for example, in *Research Disclosure I,* or in James, *The Theory of the Photographic Process* 4th, 1977.

The following examples are provided to further illustrate the invention.

EXAMPLES

To test for spectral sensitization and safelight sensitivity, dyes I-1 through I-6 were added to sulfur and gold chemically sensitized AgBrCl monodispersed cubic emulsions (60 mol % Cl) of 0.4 μm average grain size at 0.06 millimole dye per mole of silver, and the dyed emulsions were coated on paper supports. A layer of gelatin was coated over each emulsion layer, and the coatings were dried. To test for green sensitization and contrast, each coating was given an exposure through a step tablet and a KODAK POLYCONTRAST II PC 0 Filter, which allows light of wavelength longer than 490 nm to reach the coatings. To test for sensitivity to safelights, a sample of each coating was exposed for 20 seconds in a wedge spectrograph containing a Wratten 22 filter, so that only light of wavelengths greater than 560 nm reached the coating. The coatings were developed for 90 seconds in KODAK DEKTOL black and white paper developer, rinsed in acetic acid stop bath, fixed for five minutes in KODAK F5 sodium thiosulfate fixing solution, then washed and dried. After processing, the number of steps visible in the region exposed to 570 nm light was counted and taken as a measure of sensitivity to safelights.

In addition to the dyes of the invention, comparison dyes (A), (B) and (C) (illustrated below) were also tested as described above. All the dyes produced good sensitivity when exposed through the KODAK POLYCONTRAST II PC 0 filter, and could thus be used as sensitizers for variable contrast photographic elements. Safelight sensitivity for each dye was as indicated in Table I below:

TABLE I

| Dye | Number of Steps Visible at 570 nm |
|---|---|
| I-1 | 0 |
| I-2 | 0 |
| I-3 | 0 |
| I-4 | 0 |
| I-5 | 0 |
| I-6 | 0 |
| A | 3 |
| B | 4 |

TABLE I-continued

| Dye | Number of Steps Visible at 570 nm |
|---|---|
| C | 3 |

A

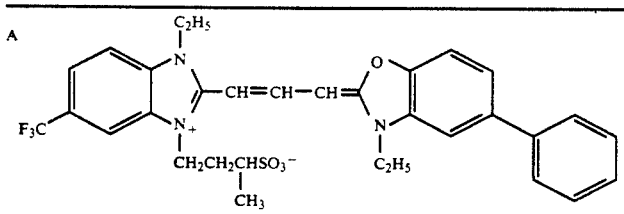

B

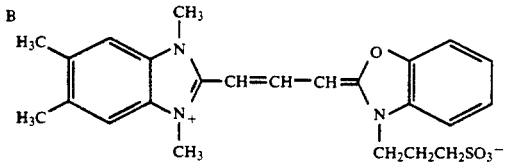

C

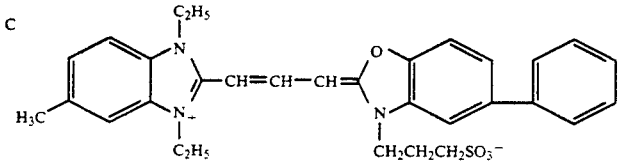

The data above demonstrate that the dyes of the invention produced coatings with essentially no sensitivity at 570 nm, while the comparison dyes demonstrated appreciable sensitivity.

The invention has been described in detail with particular reference to preferred embodiments thereof, but it will be understood that variations and modifications can be effected within the spirit and scope of the invention.

What is claimed is:

1. A variable contrast photographic element containing a light sensitive silver halide emulsion layer, wherein the silver halide is spectrally sensitized with a dye of the following formula (I):

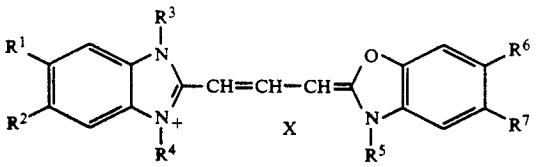

(I)

wherein $R^1$, $R^2$, $R^6$ and $R^7$ each independently represent hydrogen, halogen, hydroxy, or substituted or unsubstituted alkyl, alkenyl, alkoxy, alkylamino, alkylthio, aryl, aryloxy, arylamino, or arylthio;

$R^3$ and $R^4$ each independently represent substituted or unsubstituted alkyl;

$R^5$ represents a substituent containing an electron withdrawing group; and

X represents a counterion as needed to balance the charge of the molecule;

said dye being present in an amount less than that required to impart maximum sensitivity to all of the silver halide in the emulsion.

2. The photographic element of claim 1 wherein one of $R^3$ and $R^4$ is alkyl substituted with an anioinic substituent.

3. The photographic element of claim 2 wherein one of $R^3$ and $R^4$ is sulfoalkyl.

4. The photographic element of claim 1 wherein $R^5$ is selected from the group consisting of fluoroalkyl and cyanoalkyl.

5. The photographic element of claim 4 wherein $R^5$ is trifluoroethyl.

6. The photographic element of claim 4 wherein $R^5$ is cyanoethyl.

7. The photographic element of claim 1 wherein $R^2$ is trifluoromethyl and $R^7$ is phenyl.

8. The photographic element of claim 7 wherein one of $R^3$ and $R^4$ is alkyl substituted with an anioinic substituent.

9. The photographic element of claim 8 wherein one of $R^3$ and $R^4$ is sulfoalkyl.

10. The photographic element of claim 7 wherein $R^5$ is selected from the group consisting of fluoroalkyl and cyanoalkyl.

11. The photographic element of claim 10 wherein $R^5$ is trifluoroethyl.

12. The photographic element of claim 10 wherein $R^5$ is cyanoethyl.

13. The photographic element of claim 10 wherein one of $R^3$ and $R^4$ is alkyl substituted with an anioinic substituent.

14. The photographic element of claim 13 wherein one of $R^3$ and $R^4$ is sulfoalkyl.

15. The photographic element of claim 1 wherein the amount of dye of formula (I) added to the emulsion is sufficient to achieve a mono-layer of dye adsorbed to about 0.5 to 20% of the silver halide grain surface area.

16. The photographic element of claim 1 wherein $R^5$ contains fluoro, cyano or carbonyl.

17. The photographic element of claim 1 wherein $R^5$ is selected from the group consisting of fluoroalkyl, cyanoalkyl and carbonyl containing alkyl.

* * * * *